US005913482A

United States Patent [19]

Akeno

[11] Patent Number: 5,913,482

[45] Date of Patent: Jun. 22, 1999

[54] INTEGRALLY MOLDED SURFACE FASTENER

[75] Inventor: Mitsuru Akeno, Toyama-ken, Japan

[73] Assignee: YKK Corporation, Tokyo, Japan

[21] Appl. No.: 09/136,017

[22] Filed: Aug. 19, 1998

[30] Foreign Application Priority Data

Aug. 20, 1997 [JP] Japan ..... 9-223909

[51] Int. Cl.[6] ..... A44B 18/00

[52] U.S. Cl. ..... 24/452; 24/450

[58] Field of Search ..... 24/442, 306, 452, 24/444, 447, 448, 450

[56] References Cited

U.S. PATENT DOCUMENTS

| | | | |
|---|---|---|---|
| 5,713,111 | 2/1998 | Hattori et al. | 24/452 |
| 5,755,015 | 5/1998 | Akeno et al. | 24/452 |
| 5,781,969 | 7/1998 | Akeno et al. | 24/452 |
| 5,792,408 | 8/1998 | Akeno et al. | 24/452 X |
| 5,800,845 | 9/1998 | Akeno et al. | 24/452 X |

*Primary Examiner*—James R. Brittain
*Attorney, Agent, or Firm*—Hill & Simpson

[57] ABSTRACT

This invention provides a surface fastener of thermoplastic resin comprising, as integrally molded members thereof, a flat substrate and rows of large number of hooks standing from the substrate as engaging members and arranged continuously. The hooks of the surface fastener according to the invention hardly collapse, even if they are very small, and reliably come into engagement with mating loops of a matching surface fastener to provide a satisfactory engaging and peeling strength and a high ratio of engagement. The surface fastener according to the invention can endure repetitive engaging and disengaging operations. Each of the engaging elements has a stem, two or more than two necks extending radially in different directions from the stem and engaging heads substantially linearly extending from the stems in the different directions by way of the respective necks and each of the engaging heads has a cut-out formed at the remote end thereof transversally relative to the extending direction of the engaging head. Additionally, the top of the engaging head is substantially flat and the engaging head is tapered toward the front end thereof.

21 Claims, 8 Drawing Sheets

INTEGRALLY MOLDED SURFACE FASTENER

BACKGROUND OF THE INVENTION

1. Field of the Invention

This invention relates to a surface fastener of thermoplastic resin having a flat substrate and a large number of hooks standing from the substrate as engaging members integrally molded and arranged continuously in array. The hooks of a surface fastener according to the invention hardly collapse, even if they are very small, and reliably come into engagement with mating loops of a matching surface fastener to provide a satisfactory engaging strength and peeling strength and a high ratio of engagement. A surface fastener according to the invention can endure repetitive engaging/disengaging operations and hence is particularly suitable for use in a paper diaper, a hospital gown, a napkin, worker's clothing, underwear or the like.

2. Description of the Related Art

Surface fasteners comprising a flat substrate and a large number of hooks integrally molded of molten thermoplastic resin by extrusion are disclosed in U.S. Pat. Nos. 4,984,339 and 5,441,687. In recent years, the demand for surface fasteners of this type have remarkably increased and they are currently used as fasteners in various applications including industrial materials, interior decoration articles for both cars and dwellings, daily necessaries and sanitary goods including paper diapers. This means that the engaging elements arranged on the substrate of a surface fastener may have to be dimensioned and profiled to meet the requirements of the application.

Meanwhile, as is understood from the above-identified U.S. Patents, known apparatus for manufacturing continuously and integrally molded surface fasteners are accompanied by a drawback that, due to its technical difficulty in molding process, the produced surface fastener does not provide a delicate touch of woven fabric and that, if hooks are formed with minimal dimensions, they do not provide a sufficient strength when they are simply molded to have a size like the monofilament hooks of known woven fabric type surface fasteners, so that they lack satisfactory durability. Additionally, with a hook structure integrally molded as described above, stems of the hooks have a simple cross-sectional profile and can become easily collapsed laterally or forwardly (or backwardly) particularly when they are made very small. Still additionally, engaging heads of the hooks have a simple profile and are too soft so that they do not provide a sufficient engaging strength and can easily be released from engagement. As a result, they can quickly lose the original profile after repeated use to significantly reduce the ratio of engagement with mating loops in a short time. Therefore, hooks have to be large if the rigidity and the engaging strength of the surface fastener are to be secured to a desired level. Then, such hooks become very rigid and only a limited number of hooks can be arranged per unit area (i.e. the density of hooks), and consequently they will no longer become effectively engaged with mating loops.

In an attempt to solve the above problems, WO 94/23610, U.S. Pat. No. 5,077,870, Japanese Patent Laid-Open Publication No. 2-5947 (U.S. Pat. No. 4,894,060) and Japanese Patent Laid-Open Publication No. 6-133808 disclose integrally molded surface fasteners having fine engaging elements.

Of the above listed patent documents, both WO 94/23610 and U.S. Pat. No. 5,077,870 propose a molded surface fastener having mushroom-like engaging elements arranged in place of ordinary conventional hooks. The mushroom-like engaging elements have an advantage in comparison with the engaging elements of hook-shape that they provide an enhanced effect of engaging mating loops and are easy to secure a desired level of engaging strength even if they are dimensionally reduced so that they are suitable for applications where the surface fastener is required to have flexibility. However, such a mushroom-like engaging element can easily become engaged with a number of loops particularly at the neck that connects the engaging head and the stem of the element so that the engaging element can be broken at the neck when it is forced to disengage itself from the loops regardless of its dimensions. Thus, a proposed surface fastener comprising mushroom-like engaging elements cannot withstand repeated use.

On the other hand, Japanese Patent Laid-Open Publication No. 2-5947 discloses a molded surface fastener that includes so-called J-shaped or palm tree shaped hooks standing from the substrate, which are included in the known general hook structures. However, the patent document proposes a disposable surface fastener by taking advantage that the surface fastener comprising such engaging elements can be manufactured at low cost and they can be engaged and disengaged with a mating non-woven cloth which can be manufactured at lower cost than a fibrous pily woven fabric. Thus, such a surface fastener may be applied to various disposable underwear and paper diapers. The surface fastener comprises fine engaging elements that are densely arranged on the substrate because the engaging elements are so small that each one of the engaging elements cannot provide a sufficient effect of holding a mating non-woven surface fastener, so as to secure the engaging strength and peeling resistance with the small pily fibers as a whole.

Japanese Patent Laid-Open Publication No. 6-133808 discloses a molded surface fastener in which engaging elements have T-shaped or inverted L-shaped front configuration. It specifically defines the height from the surface of the substrate to the lower end of the engaging head of each engaging element, the length of extension of the engaging head, the vertical thickness of the engaging head, the width of the engaging head, the projected surface area of the engaging head and the gap laterally separating adjacently located engaging elements in small numerical values, which are not different significantly from their counterparts of the surface fastener having small configuration disclosed in the preceding Japanese Patent document. However, the engaging elements have a specifically designed profile that differentiate them from any known engaging elements having fine engaging elements so that they provide a soft touch and can be engaged and disengaged smoothly from the mating loops, while securing a satisfactory engaging strength.

However, only by making the engaging elements small and dense or have a relatively simple profile, an enhanced engaging ratio with regard to the loops of a mating surface fastener may be realized, but they cannot necessarily secure an increased shear nor an increased peeling strength. Additionally, if such engaging elements are arranged quite densely, when the hook-shaped engaging heads of the engaging elements are forced into the soft fibrous loops of a matching non-woven surface fastener that are arranged also densely, either the fibrous loops or the engaging elements can collapse to make mutual engagement practically impossible and reduce the engaging ratio of the surface fasteners in comparison with the ordinary surface fastener.

Thus, the above-described molded surface fastener having very small engaging elements has a lower limit for the size of each engaging element and an upper limit for the density of arranging engaging elements. While Japanese Patent Laid-Open Publication No. 2-5947 defines the measurements of various parts, the meaning of the cited critical values are not necessarily clear. According to the above patent document, preferable values are between 70 and 100 pieces/cm2 for the density of arrangement of engaging elements, between 0.8 and 1.1 mm for the height of each engaging element, about 0.4 mm for the thickness of the stem and the engaging head of each engaging element (as viewed perpendicularly relative to the direction along which the engaging head extends), between 0.18 and 0.30 mm for the width of the stem (as viewed in the direction along which the engaging head extends) and between 0.25 and 0.37 mm or less than 1 mm for the length of the engaging head extending from the stem. These figures seem to be cited in order to secure the overall engaging effect both in the shearing direction and in the peeling direction because each engaging element have only an ordinary profile and no particular profile is devised for down-sized engaging elements so that a single engaging element shows a shear and an anti-peeling effect that are very low.

For the engaging head of an ordinary J-shaped engaging element of a surface fastener to be successfully forced into a loop of a mating surface fastener, the length of the engaging head as measured from a lower end to the top of the engaging head should be made as small as possible, while the distance between the lower end of the engaging head and the surface of the substrate and the distance between any two adjacently located engaging elements should be as large as several times of the effective width of mating loops. Thus, conventionally, the size of an engaging element are defined in terms of the width of the mating loop so that, if the engaging elements of the surface fastener are molded to be small and flexible in order to adapt them to a paper diaper, for example, the engaging head of each engaging element has to show an excessively arced profile to secure a necessary engaging strength and the distance between the lower distal end of the engaging head and the substrate which is necessary for letting the loop to be inserted therein has to be unequivocally defined.

This means that the height of each engaging element and the density of arranging engaging elements are unequivocally defined if a predetermined engaging ratio is to be secured and that, as a result, the height of each engaging element cannot be reduced any further. Therefore, assuming that the material of the molded surface fastener and the weight of each engaging element are invariable, the strength of the surface fastener both in the shearing direction and in the peeling direction cannot be improved unless the engaging elements are structurally modified and improved. Additionally, since the profile of the top of the engaging head of each engaging element that is standing from the surface of the substrate is curved, it is impossible to further improve the touch of the surface fastener and requires a relatively large mating loop in order for the engaging head to be successfully forced into the loop. If the small loops of the matching surface fastener are minimized, the engaging heads are prevented from entering in the loops. Still additionally, if the engaging elements of a surface fastener are simply down-sized without changing the profile, the hook-shaped engaging heads of the engaging elements are crushed to bend forwardly or laterally to make it further difficult for them to engage with matching loops and remarkably reduce the engaging ratio.

With a molded surface fastener as disclosed in Japanese Patent Laid-Open Publication No. 6-133808, it can be anticipated that each engaging element obviously shows only a reduced engaging strength with the mating loop if compared with the molded surface fasteners of the foregoing Publications. While it is seemingly intended to compensate the reduced engaging strength by devising a novel arrangement of engaging elements, the basic idea of securing the overall engaging strength of the surface fastener is practically same as that of the preceding patent document that proposes inverted J-shaped engaging elements, so that many various factors have to be defined in order to compensate the reduced engaging strength of each engaging element and secure the overall engaging strength of the surface fastener.

In the above described T-shaped or inverted L-shaped engaging elements of the cited patent document, the engaging head of each engaging element is not positively intended to have a thickness gradually decreasing from a base end to a distal end, but it is stated that the distal end portion is tapered. It merely describes that a projecting section of the engaging head has a thickness between 0.08 and 0.35 mm at the middle thereof. However, it does not describe any means for improving the rigidity of each engaging element and the proposed profile of each engaging element is not particularly inventive. Thus, it is easily understood that the thickness cannot be reduced to be less than 0.08 mm because the rigidity of each engaging element depends simply on that of the material.

Generally speaking, when the engaging elements of the surface fastener are down-sized, the substrate of the surface fastener have to be made thinner in order to make the surface fastener more flexible. However, if the substrate is made too thin, it can be extended unevenly or torn apart when the engaging elements of the surface fastener carried on it are drawn out of the mold at the end of the molding process to make the stable molding impossible. Even if they are drawn out successfully, the thinner the substrate be, the more undulations appear to reduce the market value of the product.

In view of the above identified various problems of known surface fasteners, it is therefore the object of the present invention to provide a molded surface fastener comprising, as integrally molded members thereof, a flat substrate and a large number of ingenuously profiled hooks standing from the substrate as engaging members and arranged continuously in rows such that the engaging elements can reliably engage with mating fine and dense fibrous loops of a matching non-woven surface fastener and hence the surface fastener shows an engaging strength, a shear and a peeling strength of a desired level, while providing a comfortable touch. The height of the engaging elements of such a surface fastener can be made smaller than that of the engaging elements of any known surface fasteners and hardly collapse, so as to maintain an enhanced ratio of engagement with mating loops. Such a surface fastener is durable and shows a desired level of flexibility and anti-tearing strength.

SUMMARY OF THE INVENTION

According to the invention, the above object is achieved by providing a surface fastener comprising, as integrally molded members thereof, a flat substrate and a large number of hooks standing from the surface of the substrate as engaging members and adapted to releasably engage with mating loops of a matching surface fastener. The surface fastener is characterized in that each of the engaging elements has a stem, two or more than two necks extending in different directions from the stem and engaging heads extending from the stems in the different directions by way of the respective necks and each of the engaging heads has a cut-out formed at the remote end thereof transversally relative to the extending direction of the engaging head.

The cut-out formed at part of the engaging head makes the engaging head much more flexible than the stem and small so that it can easily come into engagement with a mating small fibrous loop and the stem can have a width in transverse direction relatively much greater than that of the engaging head so that the engaging element is less apt to collapse when it is held under pressure for engagement with a mating loop thus engagement is further promoted.

The cut-out may be formed at any position of the engaging head. Additionally, one or more than one cut-outs may be. formed on each engaging head. Normally, the cut-out is formed at a lateral edge of the corresponding engaging head along a line normal to the extending direction of the engaging head. More specifically, if each engaging element has two necks and hence two engaging heads, the cut-outs of the engaging element may be arranged in mirror symmetry relative to the boundary line of the necks extending oppositely relative to the axial line of the stem. Alternatively, the cut-outs of the engaging element may be arranged in point symmetry relative to the axial line of the stem from which the engaging heads are extending oppositely.

For the purpose of the invention, the cut-outs are formed respectively at the opposite lateral edges of the engaging head along a line normal to the extending direction of the engaging head. Alternatively, the cut-out is formed at the center of the distal end along the line normal to the extending direction of the engaging head.

In this invention, most preferably, each engaging head has, at a top thereof toward a base of the engaging head which portion is not cut-out, a bulged section protruding substantially horizontally at least in a direction normal to the extending direction of the engaging head and the top of the engaging head is substantially flat.

Preferably, each engaging head has at the top a width that is between 50 and 70% of the total width including the bulged section as viewed in the extending direction of the engaging head. In other words, the top of the engaging head has the bulged section which is formed to protrude from the remaining portion of the engaging head horizontally by 30 to 50% of the width of the engaging head. With such an arrangement, firstly, the top surface of each hook of the surface fastener is made substantially flat du e to the provision of such a bulged section so that the surface fastener may not sting the hand of the user of the surface fastener. Secondly, the flat top of each engaging head reduces the total height of the engaging element without changing the distance between the surface of the substrate and the bottom surface of the engaging head if a given amount of resin is used to form the engaging head including the bulged section. Thus, the provision of a bulged section not only down-sizes the engaging element but also allows the substrate to become flat and free from recesses.

Thirdly, the mating loop that becomes engaged with the engaging head will be held to the neck between the stem and the bulged section of the engaging element so as to make the loop hardly releasable from the engaging head and improve the engaging strength of the engaging element remarkably unlike a conventional manner in which the loop is hooked by an arced engaging head that extends with a substantially same diameter and simply hooks the loop. However, since a portion of the engaging head which corresponds to a flange of the mushroom-type engaging head is cut off at its lateral portions to form the cut-outs and the bulged section extends only in lateral directions of the stem supporting the engaging head unlike a known mushroom-type engaging head that extends in all directions from the upper end of the stem, the engaging head is elastically deformed and stands up so that the engaged loop can frictionally and smoothly move along the bulged section until it is completely released from the engaging head when the surface fastener is peeled off from the matching surface fastener even if the loop is hooked around the opposite cut-outs in the notch of the engaging head that is substantially linearly extending. In other words, the engaging element is less releasable than the conventional arced hook and more easily releasable than a mushroom-type engaging element that can damage both the engaging element itself and the mating loop when they are forced to be separated from each other. Thus, the engaging element provides an adequate engaging strength although it is very small.

The provision of the bulged section makes it possible to modify the engaging head extending from the corresponding neck. Since the bulged section improves the engaging strength of the engaging head with the mating loop as pointed out above, the engaging head is not required to be bent downward toward the substrate unlike a conventional arced hook and may simply extend linearly with a given angle from the top of the stem to show any desired appropriate profile including a T-shaped profile and a Y-shaped profile. In other words, the engaging head may be profiled so as to maximally facilitate its insertion into a mating loop, as a result, it effectively realize to insert the engaging head into a low, fine monofilament loop standing from a surface fastener of non-woven fabric densely carrying thereon such loops.

If the mating loop is a fine, small monofilament loop, the engaging head of each engaging element is preferably made to bend and extend linearly from the supporting neck with an angle of $O<\theta\leqq 35°$ between the top surface of the engaging head and the horizontal plane and an angle of $5°\leqq\theta'\leqq 45°$ between the bottom surface of the engaging head and the horizontal plane.

At the same time, it is especially effective that the engaging head is tapered toward the front end such that the thickness of the front end of the engaging head is between 50 and 90% of the thickness of the base of the engaging head. The use of such a tapered profile of the engaging head is not feasible with any known engaging element that may be J-shaped or inverted L-shaped if a given engaging strength is to be secured. For the purpose of the invention, the engaging head or at least the bulged section of each engaging head is made more rigid than the remaining parts of the engaging element including the stem and the substrate. With this arrangement, the engaging element can hold the mating engaging element more securely, while stably maintaining its own proper profile.

As the stem of each engaging element rises vertically from the surface of the substrate and a surface of the stem on the side of extension of the engaging head is located substantially directly under the center of the top of the engaging head. The engaging head is securely supported from below when the engaging element is held under pressure to prevent the engaging head from being easily deformed. In view of that the surface fastener of this type is produced continuously as a long strip, the engaging elements standing on the surface of the substrate may more often than not be held under pressure at the risk of being deformed as the strip is wound for storage and transportation. However, with the above described arrangement that the surface of the stem on the side of extension of the engaging head is located substantially directly under the center of the top of the engaging head, it will be appreciated that the engaging elements can easily withstand the pressure and remain undeformed.

Further, as the oppositely disposed rear sides of the necks of each engaging element rise aslant from the center of the top of the stem in diverging directions, and the bottom of a gap between the rear sides of the necks of each engaging element is located on a line connecting lower ends of the bottom surfaces of the engaging heads, the individual necks can elastically be deformed more easily than the stem so that the mating loops can be easily engaged with and released from the respective engaging heads.

In this invention, as a desired number of recesses are preferably provided on the surface of the flat substrate at desired locations thereof and each engaging element rises from the bottom of corresponding one of the recesses, the apparent height of each engaging element projecting on the surface of the substrate is apparently reduced, because the distance between the lower front end of the engaging head and the surface of the substrate equals to the value obtained by subtracting the depth of the recess from the distance between the lower front end of the engaging head and the bottom of the recess from which the stem is rising even though the actual height of the engaging element rising from the substrate remains unchanged.

Thus, the arrangement of recesses on the surface of the substrate remarkably improve the flexibility of the backing although its apparent thickness is unchanged. Also, the surface fastener can be drawn out of the mold at the end of the molding process without the substrate being extended unevenly or torn apart. As a result, the substrate of the molded product will be free from undulations, sufficiently. durable for practical use and is of high quality. If the height of the stem from the bottom of the corresponding recess is between ⅕ and 9/10 of the height of the front end of the top of the engaging head from the bottom of the recess, the neck structurally exists to improve the flexibility of the engaging head and, because the stem apparently stands relatively low from the general surface of the substrate, the stem is less collapsible and more stable when the engaging element is engaged with one or more than one mating loops. Preferably, each recess has a width large enough to allow a mating loop to be introduced therein.

In this invention, as a preferable size of the engaging element, the height of the top of the front end of the engaging head of each engaging element from the surface of the substrate is between 0.2 and 1.2 mm and the front end of the engaging head extends from the stem by a distance between 0.05 and 0.7 mm, while the stem has a height between 0 and 1.0 mm. These values defines the ranges of basic values where engaging head can securely come into engagement with a mating fine and small loop without rigid feeling. The lower limit values are those that ensure a reliable engagement with a minimal fibrous loop of a matching surface fastener of non-woven fabric.

When the total area of the flat top surfaces of the engaging heads of the engaging elements of a surface fastener according to the invention takes about 20 to 50%, preferably 32 to 40%, of the surface area of the substrate of the surface fastener, the surface fastener provides a satisfactory engaging ratio with the matching surface fastener carrying the mating loops thereon and, at the same time, the engaging heads would not sting the hand of the user of the surface fastener. When a continuously molded surface fastener according to the invention and having the above described configuration and dimensions is fitted to paper diapers in a continuous process, the strip of surface fastener being continuously fed is successively cut to pieces having a desired length and each piece is sucked by a suction roll having a fixed sucking section on part of the inner peripheral wall thereof at the side of the piece of surface fastener where the engaging elements are arranged. Then, the piece of surface fastener is rotated on the suction roll and transferred onto and attached to a given area of the paper diaper that have been moved along a transportation path normal to the rotating direction of the piece of surface fastener. In order to carry out this attaching operation successfully, the piece of surface fastener has to be sucked reliably and efficiently on the suction roll and transferred. This reliable suction on the suction roll is achieved when ratio of the total area of the flat top surfaces of the engaging heads to the surface area of the substrate is set to the above identified value.

The molded surface fastener according to the invention can be manufactured continuously in a manner as described below. Molten resin continuously extruded from an extrusion nozzle under predetermined resin pressure is continuously applied on the peripheral surface of a revolving die wheel so that the molten resin is partly used to form a substrate having a predetermined thickness along the peripheral surface of the die wheel, while the remaining molten resin applied onto the peripheral surface of the die wheel is used to fill a large number of cavities for forming engaging elements arranged on the peripheral surface so that a continuous strip of intermediary surface fastener comprising the substrate and the engaging elements integrally molded with the substrate is produced. Each of the cavities for forming engaging elements normally shows a Y-shaped cross section, where the bifurcated legs extend at a bending angle between 90° and 180°. The bending angle is reduced and a bulged section is formed at each engaging head as the engaging heads are pressed by heating and pressing means to produce engaging elements showing the above described profile.

The cavities for forming engaging elements of the invention has a characteristic profile. While each of the cavities is Y-shaped in longitudinal cross section, the cavity where the engaging head extending from the stem is molded is partly lost transversely as seen from the top where engaging head is molded. This part serves to form front the end of the engaging head having the above-described any number of cut-out which may be provided at various positions.

The intermediary surface fastener of the invention is positively cooled and solidified by water cooling means or by some other cooling means arranged inside the die wheel as the intermediary surface fastener is rotated by a half of the periphery of the die wheel. The cooling operation is intended to solidify the material of the intermediary surface fastener before the crystallization of the material so that the obtained substrate and engaging elements may show a considerable degree of flexibility as a whole. Thus, the produced surface fastener will particularly be suitable to be used as fasteners for underwear, paper diapers, hospital gowns for patients and other similar applications.

When the solidified substrate of the surface fastener is taken up by a take-up roller, the engaging elements molded, cooled and solidified in the respective cavities are elastically deformed linearly and drawn out of the cavities without problem. Particularly, when the oppositely disposed rear sides of the necks of each engaging element are made to rise aslant from the center of the top of the stem in diverging directions, the length of each of the engaging heads extending from the respective necks of an engaging element is reduced to somewhere between ⅔ and ½ of the length of the stem while the width normal to the extending direction of the stem can also be reduced due to the cut-out formed in the engaging head so that engaging elements can be drawn out from the respective cavities with ease.

Thus the top of the produced intermediary surface fastener is then subjected to a heating and pressing process where each engaging head including its base and distal end is heated and pressed by the heating and pressing means until the engaging head and the corresponding neck become slightly inclined forwardly. While the engaging heads of each engaging element of a surface fastener according to the invention may show such an inclined profile, it is preferable that each of the engaging heads is softened at the top in the heating and pressing process and additionally deformed to produce a substantially flat top surface and the portion of the engaging head which is left not cut out may be extended laterally to produce a bulged section before the surface fastener is finished as a final product in which a number of engaging elements having above-described features standing on the flat substrate.

What is notable about the above described process of manufacturing the surface fastener according to the invention is that the molded surface fastener is not particularly cooled by specifically arranged cooling means after passing through the heating and pressing means and simply taken up by a take-up roller at room temperature. As the heated and softened top of each engaging head is gradually cooled in the atmosphere, the engaging head and the heated area around it are crystallized to become more rigid than the stem supporting the engaging head. The heated area of the engaging head and the duration and the temperature of the heating operation can be appropriately controlled in accordance with the dimensions and the profile of the engaging elements.

Thus, in the intermediary surface fastener having the substrate and the engaging elements that have been cooled quickly to prevent excessive crystallization so as to be flexible, the top of each engaging head is made more rigid than the remaining portions of the engaging element. Therefore, even if the engaging elements of the surface fastener are made very small and flexible, the top of each engaging head has the satisfactory rigidity and significant resistivity against bending and shearing in addition to the engaging strength and the peeling strength.

DETAILED DESCRIPTION OF THE PREFERRED EMBODIMENTS

Now, the present invention will be described by referring to t he accompanying drawings that illustrate preferred embodiments of the invention.

Figure 1:
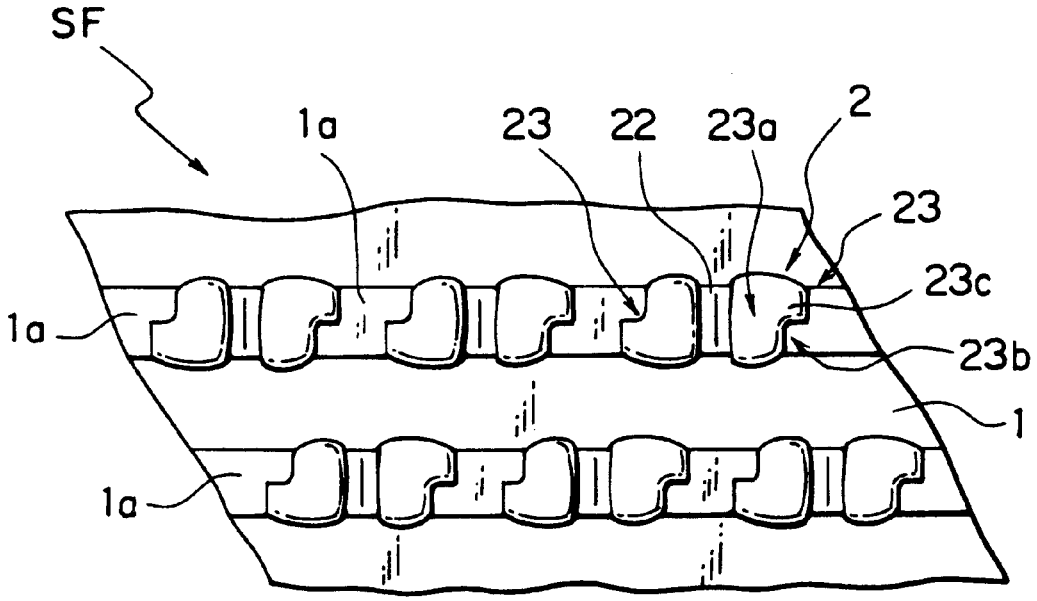
FIG. 1 is a schematic partial plan view of a first embodiment of molded surface fastener according to the invention.
Figure 2:
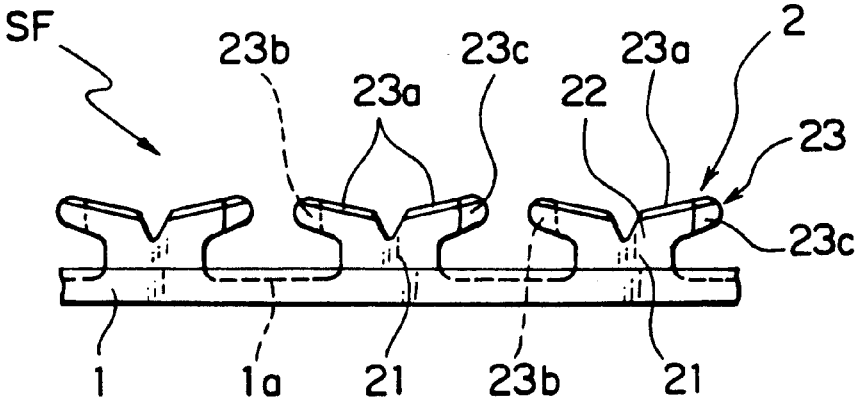
FIG. 2 is a schematic lateral view of the embodiment of FIG. 1.
Figure 3:
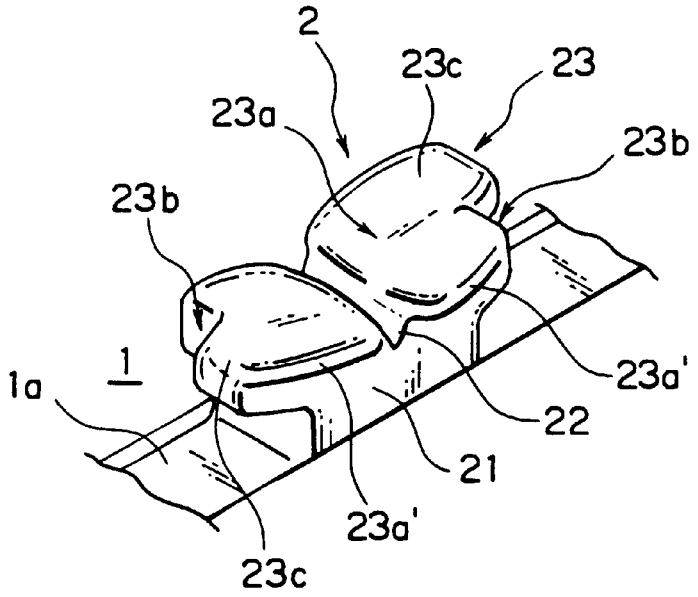
FIG. 3 is a fragmentary enlarged perspective view of the embodiment of FIG. 1.

FIG. 1 is a schematic partial plan view of a molded surf ace fastener, showing a first embodiment of typical engaging elements according to the invention. FIG. 2 is a schematic lateral view of the embodiment of FIG. 1. FIG. 3 is an enlarged perspective view of the embodiment of FIG. 1, showing only one engaging element thereof.

Referring to the drawings, engaging elements 2 are integrally formed in parallel rows on a surface of a flat substrate 1. Each engaging element 2 has a stem 21 vertically standing from the surface of the substrate 1, a pair of necks 22 branched from the upper end of the stem 21 and a pair of engaging heads 23 extending from the respective necks 22 and rising linearly aslant in opposite directions. While the paired engaging heads 23 of this embodiment extend in opposite directions, it may alternatively be so arranged that three or more than three engaging heads extend from a single stem preferably radially so that there would be no specific directivity in engagement of the engaging elements 2.

In this embodiment, a linear recess 1*a* is formed continuously along each row of engaging elements 2 on the surface of the substrate 1 and the engaging elements 2 stand from the bottom of the recess 1*a* at regular intervals with stems 21 standing upright. Note that the lateral walls of each recess 1*a* are integral with side surfaces of the stems 21 of the row. Thus, as a matter of fact, a substantially rectangular recess 1*a* is formed between any two adjacently located stems 21. As illustrated and pointed out above, engaging elements are arranged in straight and parallel rows. Note that the contour of the recesses are not limited to the one described above and individual recesses 1*a* in the row of engaging elements may be totally independent from each other. Alternatively, recesses 1*a* may be arranged in a zig-zag manner on the surface of the substrate 1.

In each engaging element of the surface fastener SF of this embodiment having a basic configuration as described above, the apparent height H1' of each engaging element between the surface of the substrate 1 except for the recess 1*a* and the top 0 of the engaging heads 23 is equal to the difference between the real height H1 of the engaging element 2 between the bottom of the stem 21 (or the bottom of the recess 1*a*) and the top 0 of each of the paired engaging head 23 and the depth d1 of the recess 1*a*. Thus, though the real height H1 is the same as conventional, the apparent height H1' of the engaging element 2 on the substrate 1 is determined by subtracting the depth d1 of the recess 1*a* from the real height H1. In other words, the provision of recesses 1*a* on the surface of the substrate remarkably improves the flexibility of the substrate 1 though the substrate 1 has the thickness same as conventional, and hence the molded surface fastener SF can be easily drawn out of the mold without undesirably extending and/or tearing the substrate 1. As a result, the molded product is not undulated to obtain high-quality products durable for practical use.

When each engaging element 2 of the surface fastener SF of this embodiment comes into engagement with a mating loop (not shown) of a matching surface fastener, the front end of the loop is typically led into the recess 1*a* to a position located below the related engaging head 23 and then it is guided to the bottom of the stem 21 of the engaging element 2 so that the engaging head 23 can smoothly and easily move into the loop for mutual engagement as in the case of known surface fasteners in which the substrate is a mere flat plate.

A first characteristic feature of each engaging element 2 of a surface fastener of this embodiment according to the. invention is that a cut-out 23*b* is formed at the top of each of the engaging heads 23 by removing the front end 23*c* of the engaging head 23 laterally by ½ and longitudinally by ⅓ as clearly seen in FIGS. 1 and 3, showing the top 23 of each of the engaging heads 23 of the engaging element 2 from above. Note that, in the illustrated embodiment, the cut-outs 23*b* of the engaging heads 23 are arranged in point-symmetry relative to the central axis of the stem 21.

Figure 4:
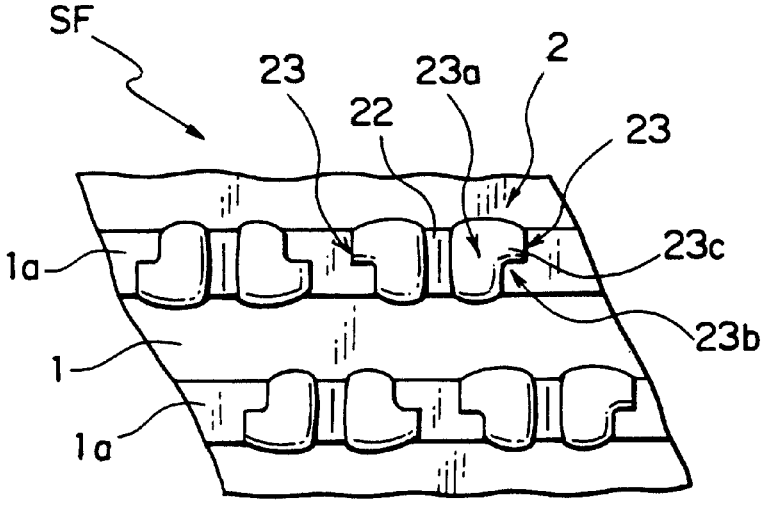
FIG. 4 is a schematic partial plan view of a second embodiment of molded surf ace fastener according to the invention.
Figure 5:
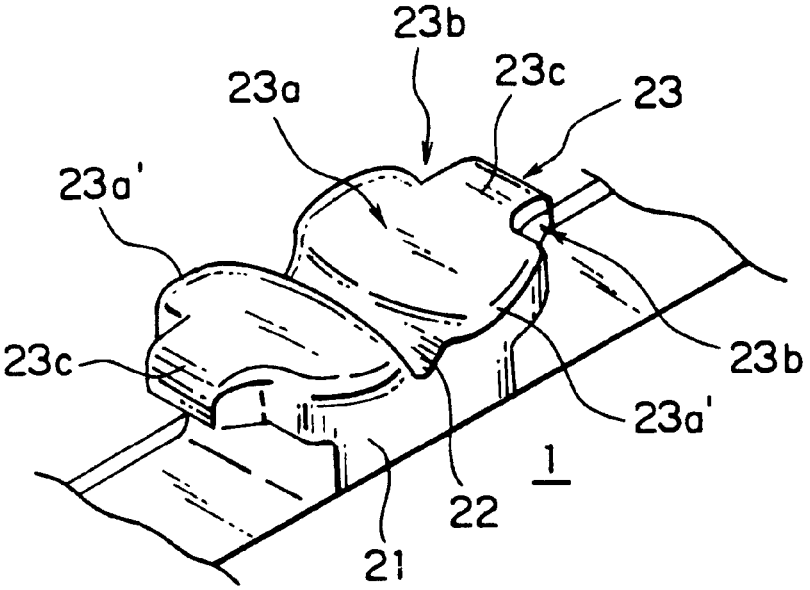
FIG. 5 is a schematic perspective view of another engaging element that can also be used for a molded surface fastener according to the invention.

Of course, the contour, the dimensions and the location of the cut-outs 23*b* of the engaging element 2 may be modified. For example, FIG. 4 shows a modified arrangement of notches 23*b*, where the cut-outs 23*b* of the paired engaging heads 23 extending in opposite directions from the stem 21 via the necks 22 are arranged in mirror-symmetry relative to the line separating the necks 22 of the engaging heads 23 branching from the stem 21. Alternatively, two or more than two cut-outs 23*b* may be formed in each engaging head 23. FIG. 5 shows a modified arrangement of cut-outs, where a pair of cut-outs are formed in each engaging head by removing the front end of the engaging head 23 by ⅓ from the opposite sides in width direction perpendicular to the direction of engaging heads extension to leave only ⅓ of the front end 23*c* at the middle.

Figure 6:
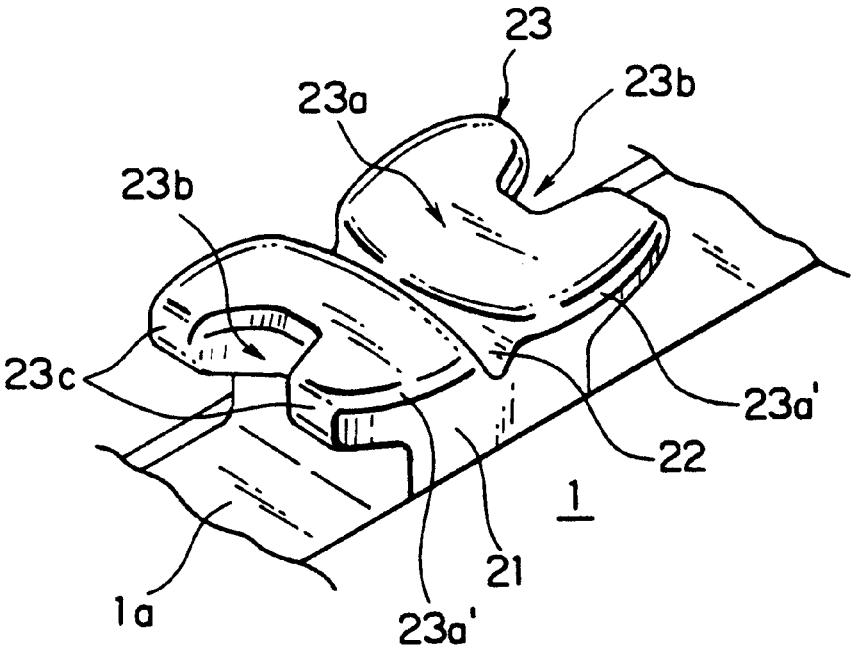
FIG. 6 is a schematic perspective view of still another engaging element that can also be used for a molded surface fastener according to the invention.

FIG. 6 shows an other modified arrangement of cut-outs, where a single cut-out 23*b* is formed at the middle in width direction of the front end of each engaging head 23. Thus, it shall be understood that cut-outs 23*b* may be arranged in various different ways in a surface fastener according to the invention.

For the purpose of the invention, assuming that by providing one or more cut-out 23*b* as described above in part of the engaging head 23, the width of the front end 23*c* of each engaging head 23 that comes into engagement with a mating loop first is the same as that of the conventional small value, the stem 21, the neck 22 and the engaging head 23 may have a width approximately twice to three times as large as the conventional. This means that the engaging elements 2 of a surface fastener according to the invention is highly resistant against pressure applied from above and hence can easily engage with mating loops of a matching surface fastener particularly in view of the fact that a plurality of engaging heads 23 extends linearly and radially from a single stem 21 by way of respective necks 22.

Each engaging element 2 having the single stem 21 and the plurality of engaging heads 23 radially extending from the stem 21 can engage with mating loops in two different ways. Firstly, the single loop can come into engagement with the single engaging head 23 extending from the stem 21. Secondly, the single loop can come into engagement with two or more than two of the engaging heads 23 extending from the stem 21. In actual use, these two forms of engagement may coexist and the engaging strength and peeling strength of the surface fastener substantially rely on the latter form of engagement. When the engaging elements 2 of a surface fastener according to the invention engage with mating loops of a matching surface fastener, they show a strong resistance against force applied in shearing direction because the stems 21 and the necks 22 are significantly greater than the front ends of the engaging heads 23 in any embodiments.

A second characteristic feature of each engaging element 2 of a surface fastener of this embodiment according to the invention is that the top 23*a* of each of the engaging heads 23 is mostly constituted by a flat plane P except the front end of the engaging head 23. In the illustrated embodiment, the flat plane P has an elliptic contour, although the contour of the flat plane P is not limited thereto and may alternatively be such that a half ellipse is added to each of a pair of opposite long sides of a rectangle. The total surface area of the flat planes P of the engaging elements of a surface fastener is preferably between 20 and 50% of the surface area of the substrate 1. It will be appreciated from FIGS. 2, 3, 5 and 6 that the flat plane P of each engaging head 23 is laterally extended to form bulged sections 23*a'*.

Figure 7A:
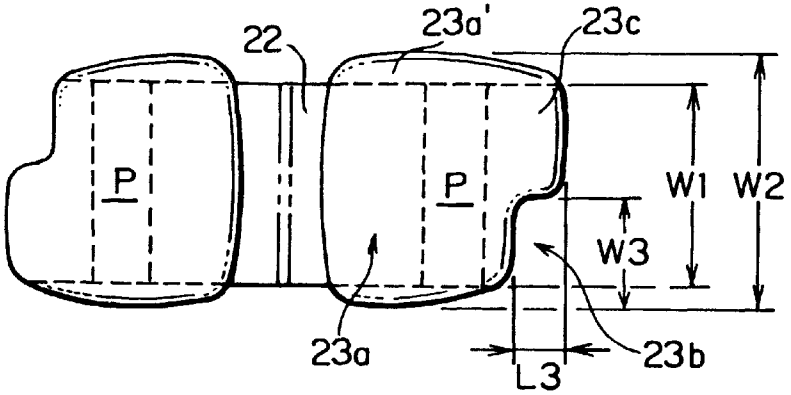
FIG. 7A, 7B and 7C are enlarged schematic views of a typical engaging element that can be used for a molded surface fastener according to the invention.
Figure 7B:
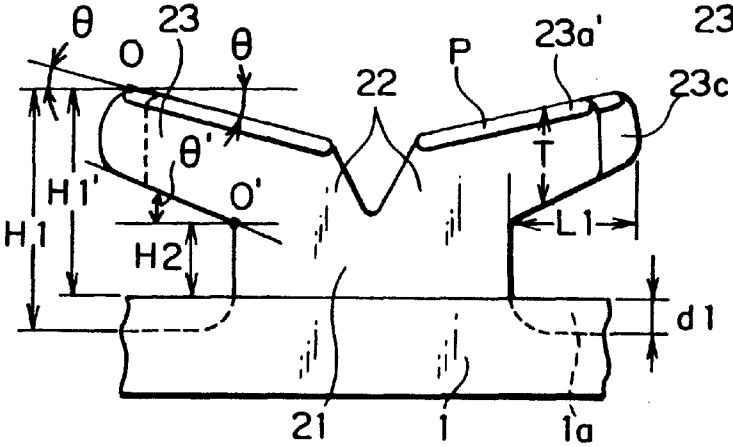
Figure 7C:
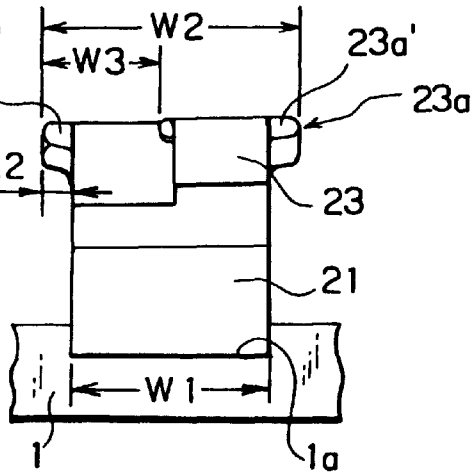

The provision of bulged sections 23*a*' is as significant as that of flat planes P for the purpose of the invention. In this invention, referring to FIG. 7, the width W1 of each engaging head 23 excluding the bulged sections 23*a*' perpendicular to the extending direction of the engaging head 23 is preferably between 50 and 70% of the width W2 of the engaging head 23 including the bulged sections 23*a*' in the same direction.

A third characteristic feature of each engaging element 2 of a surface fastener of this embodiment according to the invention lies in the profile of each engaging head 23 bent and extended from the corresponding stem 21 by way of a neck 22 as viewed from a lateral side. As seen from FIG. 7, the engaging head 23 is tapered vertically from the base O' toward the front end to gradually lose its thickness. The rate of reduction $\Delta T$ in the thickness is preferably between 10 and 50%. An angle $\theta$ between the flat plane P of the engaging head 23 bending and extending from the neck 22 and the horizontal plane shows an angle of $0<\theta\leqq 35°$ and an angle between the bottom surface of the engaging head 23 and the horizontal plane shows an angle of $5\leqq\theta'\leqq 45°$. The engaging head 23 is slightly and inclinedly rises upward and extends linearly. Note that the inclination angle $\theta$ of the flat plane P of the engaging head 23 is slightly smaller than the inclination angle $\theta'$ of the bottom surface of the engaging head 23. This means that the engaging head 23 can easily move into the mating loop until the base of the engaging head 23 contacts the loop if the latter if small and has a low profile.

Additionally, the entire engaging head 23 including part of the neck 22 or at least the top 23*a* including the bulged sections 23*a*' of the above embodiment is made more rigid than the substrate 1 and the stem 21 so that the engaging head 23 may stably maintain its profile and hence show an effect of stably holding the mating loop. Still additionally, the stem 21 is standing upright from the surface of the substrate i and, at the same time, the center of the flat plane P at the top of the engaging head 23 extending from the stem is located substantially directly above the respective front side of the stem 21 where two engaging heads 23 extend. By locating each of the front sides of the stem 21 at the sides where the engaging heads 23 extend substantially under the center of the flat plane P, even when a great pressing force is exerted from the above onto the top 23*a* of the engaging element 2, the engaging element 2 can endure the pressing force and is prevented from being deformed.

Still additionally, in the above described embodiment, the confronting rear sides 22*a* of the pair of necks 22 of each engaging element 2 rise aslant from the center of the top of the stem 21 to enlarge the gap separating them. While the gap separating the rear sides 22*a* of the two necks 22 is substantially V-shaped in the illustrated embodiment, it may alternatively show a U-shaped profile or some other profile. While the bottom of the gap separating the rear sides 22*a* of the necks 22 may be disposed appropriately, it is preferably located slightly above or below a line connecting the lower ends of the bottom surfaces of the engaging heads 23. With such a deep gap, the necks 22 can easily and elastically be deformed to smoothly release the mating loops that have been engaged with the engaging heads 23.

Referring again to FIG. 7, the height H1' of each engaging element 2 between the top O of the front end 23*c* of each of the engaging heads 23 and the surface of the substrate 1 is between 0.2 and 1.2 mm and the horizontal length L1 of the engaging head 23 extending from the stem 21 is between 0.05 and 0.7 mm, while the height H2 of the stem 21 is between 0 and 0.1 mm. Note that the height H2 of the stem 21 refers to the distance between the top O' of the stem 21 and the surface of the substrate 1 except for the recesses 1*a* formed thereon. Thus, in case that the substrate 1 has the recess 1*a*, if the height H2 of the stem 21 is equal to 0 mm, the stem 21 is standing from the bottom of the recess 1*a* having a height equal to the depth d1 of the recess 1*a*. On the other hand, in case that no recesses 1*a* are formed in the substrate 1, if the height H2 of the stem 21 is equal to 0 mm, there is no stem 21 at all and a plurality of engaging heads 23 are standing from the respective necks 22 that are by turn standing directly from the surface of the substrate 1.

Now, the dimensions of the typical engaging element 2 shown in FIGS. 1 through 3 will be discussed. The height H1' of the top O of the front end of the engaging head 23 from the surface of the substrate 1 is 0.297 mm (the height H1 of the top O from the bottom of the recess 1*a* is 0.348 mm) and the horizontal length L1 of the engaging head 23 from the stem 21 is 0.152, while the height H2 of the stem 21 from the surface of the substrate 1 is 0.125 mm. The cut-out 23*b* formed in the engaging head 23 has a width W3 of 0.17 mm and a length L3 of 0.076 mm which is equal to the length of the front end 23*c* projecting forwardly. The inclination angle θ of the flat plane P of the engaging head 23 relative to the horizontal plane is 13.3° and the inclination angle θ' of the bottom surface of the engaging head 23 relative to a horizontal plane is 13.6°. The width W2 of the top 23*a* including the bulged sections 23*a*' at the base of the engaging head 23 is 0.526 mm and the width W1 of the stem 21, the neck 22 and the engaging head 23 except the top 23*a* is 0.30 mm, while the length L2 of each of the left and right bulged sections 23*a*' is 0.044 mm. The total surface area of the flat planes P of the engaging heads 23 takes about 35% of the total surface area of the substrate 1 and engaging heads 23 are arranged at a rate of 40 to 150 heads/$cm^2$. Note that these values are listed only as preferable examples and they may be modified appropriately by taking the relationship with the mating loops of the matching surface fastener into consideration, and not limited to the above-described values.

The provision of bulged sections 23*a*' gives rise to various functional effects that cannot be expected from known J-shaped, L-shaped or T-shaped engaging elements.

One of such functional effects is that the top surface of each engaging head 23 can be made to be substantially the flat plane P and hence it does not give itcy feeling.

Secondly, if a given amount of resin is used for forming the top 23*a* of the engaging head 23 including the bulged sections 23*a*', the height of the top of the engaging head 23 from the surface of the substrate 1 can be reduced without altering the height of the bottom surface of the engaging head 23. As a result, the engaging element 2 can be downsized and, additionally as seen from FIGS. 1 through 3, the surface of the substrate 1 may be made flat without forming recesses 1*a* in it.

Thirdly, the provision of bulged sections 23*a*' remarkably improve the engaging strength of the engaging head 23 because, unlike a conventional hook-shaped engaging head that extends with a substantially same diameter and simply hooks the loop, the mating loop that becomes engaged with the engaging head 23 will be held around the neck 22 between the stem 21 and the bulged sections 23*a*' of the engaging head 23 to make the mating loop hardly releasable. However, since the bulged sections 23*a*' extend only in lateral directions of the stem 21 supporting the engaging heads 23 extending radially in given directions from the stem 21 unlike known mushroom-type engaging heads that extend in all directions, even if the loop is hooked around the neck 22 of respective engaging head 23 extending substantially straight, the engaging heads 23 are elastically deformed and stand up so that the engaged loops can smoothly move with slight friction along the bulged sections 23*a*' until they are completely released from the respective engaging heads 23 as the engaging heads 23 are elastically deformed with the necks 22 to become straight when the surface fastener is peeled off from the matching surface fastener. So, the engaging heads of the surface fastener of this embodiment shows a releasing strength that is sufficiently greater than a conventional surface fastener having simply J-shaped engaging heads and significantly smaller than a known surface fastener having mushroom-shaped engaging heads. Thus, a surface fastener according to the invention provides a required engaging strength without damaging both the engaging elements 2 and the mating loops although the engaging elements 2 are sized to be very small.

Additionally, the bulged sections 23*a*' contributes to modify the profile of the engaging heads as pointed out above. More specifically, as the provision of bulged sections 23*a*' improve the engaging strength with mating loops as described above, the engaging heads 23 may be so profiled that they are simply bent and extended linearly and slightly upward from the tops of the respective stems 21. This means that each engaging head 23 can easily move into the mating loop and, as a result, the engaging heads of the surface fastener according to the invention can be effectively engaged with fine and small monofilament loops densely arranged on the matching surface fastener made of non-woven fabric.

While the engaging elements 2 in one row are arranged exactly side by side with the engaging elements 2 of the adjacently located rows in the above embodiment, the engaging elements 2 of any two adjacently located rows may alternatively be arranged in a zig-zag manner. With such an arrangement, the flat substrate 1 of the surface fastener can surely be prevented from tearing in a direction normal to the rows of engaging elements.

A surface fastener according to the invention can be manufactured continuously by means of an apparatus disclosed in U.S. Pat. No. 4,984,339 or an apparatus disclosed in U.S. Pat. No. 5,441,687.

Figure 8:
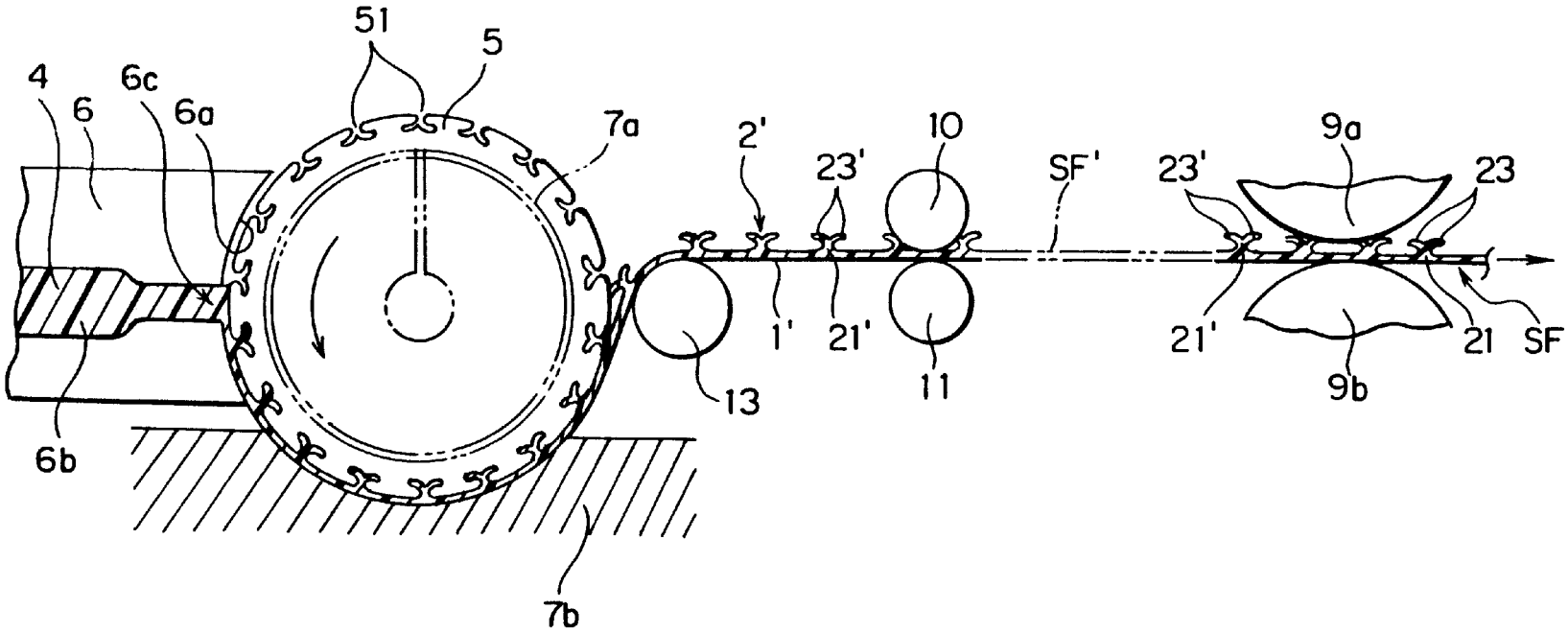
FIG. 8 is a schematic illustration of the process of manufacturing a molded surface fastener according to the invention.

FIG. 8 schematically illustrates an apparatus adapted to continuously manufacture the surface fastener according to the invention. Referring to FIG. 8, there are shown an injection nozzle 6 having an arced front surface 6*a* with radium of curvature substantially same as that of die wheel 5 which will be described in greater detail hereinafter. The arched front end 6*a* of the injection nozzle 6 and the outer peripheral surface of the die wheel 5 are separated by a gap corresponding to the thickness of the substrate 1 to be formed by the resin material injected through the nozzle 6. The injection nozzle 6 is a T-shaped die and has a rein injection port 6*c* arranged at the center of the arced front surface 6*a*, through which molten resin 4 is continuously injected at a predetermined flow rate under predetermined resin pressure to form a sheet of resin. The injection nozzle 6 has a single molten resin flow path 6*b* at the center.

The die wheel 5 has a basic configuration obtained by slightly modifying that of a die wheel disclosed in either of the above listed U.S. patent documents and therefore will be described only briefly here. The die wheel 5 is a hollow drum containing therein a water-cooling jacket 7*a* operating as internal cooling means and a number of plates are sequentially laid one on the other around the axis of rotation to form a multilayer structure of the die wheel 5 as shown in FIG. 8. The outer peripheral surface of the die wheel 5 operates as mold for molding part of a surface fastener SF and separated from the arced front surface 6*a* of the injection nozzle 6 by the above-described gap, the axis of rotation of the die wheel 5 being parallel with the injection port 6*c* of the injection nozzle 6. The die wheel 5 has a number of engaging element forming cavities 51 having a substantially Y-shaped cross section and arranged in parallel rows running along the rotating direction of the die wheel on the outer peripheral surface thereof, said rows of cavities being arranged at regular intervals. A ring of U-shaped groove is arranged between any two adjacently located rows of cavities and operates as a cavity for forming part of the upper surface of the substrate 1 located between the rows of stems 21 and engaging heads 23.

Figure 9:
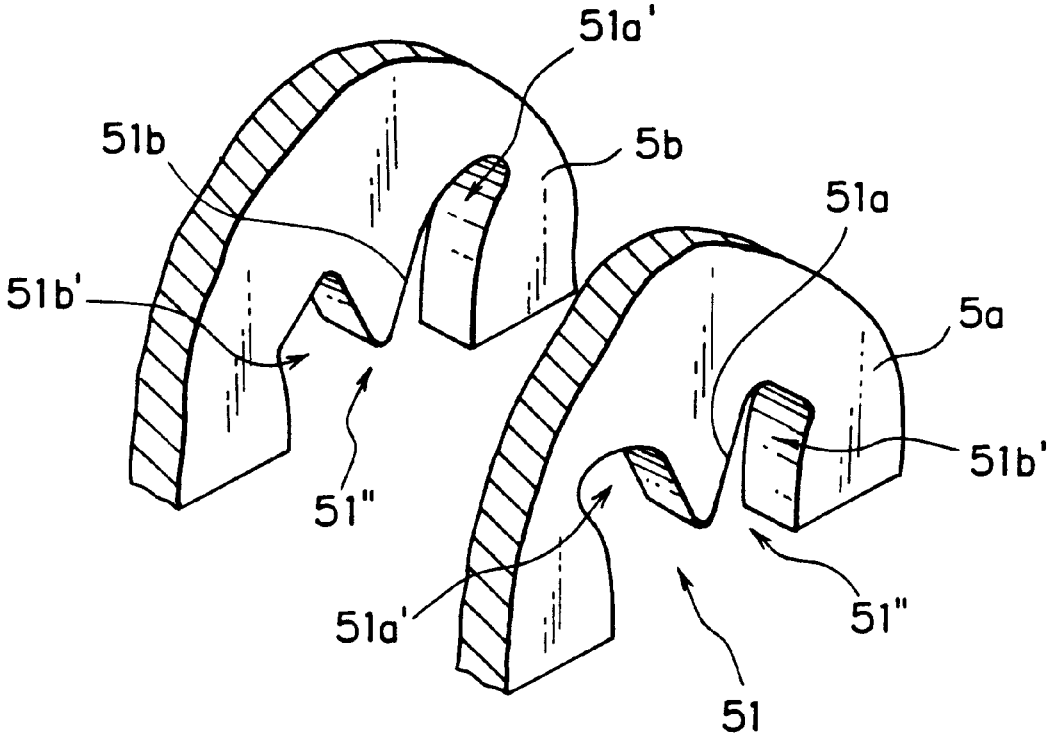
FIG. 9 is an exploded perspective view of part of a die wheel that can be used for manufacturing a molded surface fastener according to the invention, showing the profile of a cavity of the die wheel.
Figure 10:
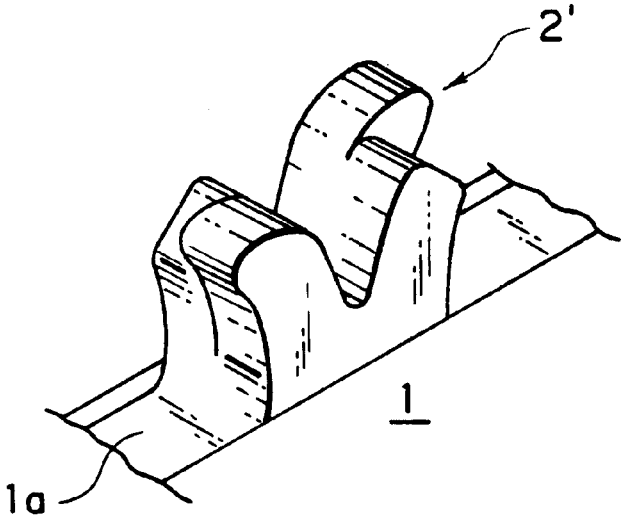
FIG. 10 is a schematic perspective view of an intermediary engaging element that can be produced from the cavity of FIG. 9.

FIG. 9 schematically illustrates a cavity 51 for molding an engaging element. Referring to FIG. 9, a pair of doughnut-shape plates 5*a*, 5*b* are provided with respective notches 51*a*, 51*b* cut from the respective flat sides of the plates. The notches 51*a*, 51*b* are of the same profile and symmetrically shaped. Each of the notches 51*a*, 51*b* is substantially Y-shaped but one bifurcated leg 51*b*' is shorter than the other leg 51*a*'. The axes of the two doughnut-shape plates 5*a*, 5*b* are aligned such that base portions 51", 51" of the notches 51*a*, 51*b* are arranged exactly side by side and the bifurcated legs 51*a*', 51*b*' of the plate 5*a* are located vis-a-vis the legs 51*b*', 51*a*' of the plate 5*b*. Then, the plates 5*a*, 5*b* are sandwiched by a pair of blank plates to produce cavities 51 for forming engaging elements. FIG. 10 shows an intermediary engaging element 2' molded by such a cavity 51 for forming an engaging element as shown in FIG. 9. The intermediary engaging element 2' is then subjected to a heating/pressing process as will be described hereinafter to produce an engaging element 2 as shown in FIGS. 1 through 3.

Figure 11:
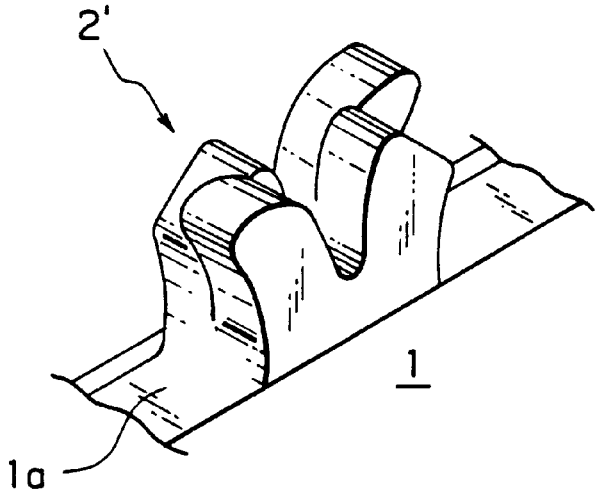
FIG. 11 is a schematic perspective view of another intermediary engaging element that can also be produced for the purpose of the invention.
Figure 12:
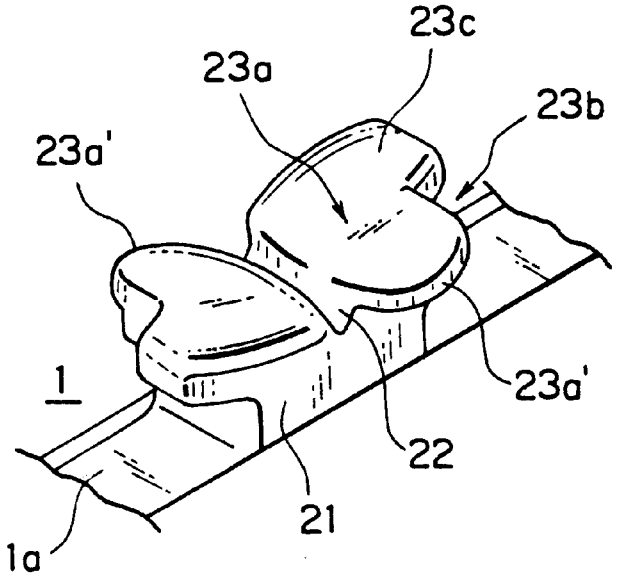
FIG. 12 is a schematic perspective view of a finished engaging element produced from an intermediary engaging element.

While the bifurcated legs 51*a*' and 51*b*' are inclined by the same angle relative to the surface of the substrate 1, they may alternatively be tilted by respective angles that are different from each other. More specifically, the angle of inclination of the leg 51*b*' that is shorter than the leg 51*a*' may be made steeper than that of the latter and the leg 51*a*' has a notch at the front end slightly greater than that of the leg 51*b*'. FIG. 11 shows an intermediary engaging element 2' molded by such a cavity 51. FIG. 12 shows an engaging element 2 produced from the intermediary engaging element 2' of FIG. 11 after a heating and pressing process.

It may be appreciated by comparing the engaging element 2 of FIGS. 1 through 3 and the engaging element 2 of FIG. 12 that the bulged sections 23*a*' of the latter is laterally projecting more than those of the former. Thus, it will be understood that the profile of each cut-out 23*b* and that of each bulged section 23*a*' formed on the engaging head 23 can be modified by appropriately defining the profile of the cavity 51 for molding an intermediary engaging element.

The die wheel 5 having the above described configuration is then driven to rotate in a direction as indicated by an arrow in FIG. 8 by means of a conventional drive unit (not shown). A cooling water tank 7*b* is disposed under the die wheel 5 so that almost the lower half of the die wheel 5 is immersed in the water contained in cooling water tank 7*b*. A pair of take-up rollers 10, 11 and a trimming unit (not shown) are arranged above the cooling water tank 7*b* and down stream relative to the die wheel 5. The trimming unit having cutting means for cutting the selvage of the molded intermediary surface fastener SF' to finish it is provided. A vertical pair of upper and lower rollers 9*a*, 9*b* are arranged downstream of the trimming unit to form bulged sections 23*a*' on each engaging head 23.

The upper roller 9*a* has a heat source (not shown) inside to keep the surface temperature of the roller 9*a* to a level adapted to soften the resin of the molded surface fastener SF. The lowermost end of the peripheral surface of the upper roller 9*a* is located slightly lower than the level of the engaging heads 23' of the intermediary surface fastener SF' passing by. The accurate level of the lowermost end of the peripheral surface of the upper roll 9*a* is determined as a function of the dimensions of the bulged sections 23*a*' extended from the respective lateral sides of the top 23*a* of each engaging head 23. On the other hand, the uppermost end of the peripheral surface of the lower roller 9*b* arranged vis-a-vis the upper roller 9*a* is located on the level of the lower surface of the moving substrate 1 of the intermediary surface fastener SF'. The axis of the upper roller 9*a* is adjustable by regulating means (not shown) and the heating temperature of the upper roller 9*a* is also regulatable as a function of the resin material used for the surface fastener. While both the upper and lower rollers 9*a*, 9*b* may be driven synchronously by means of the same drive unit, at least the upper roller 9*a* is driven to rotate by the drive unit (not shown) such as an electric motor connected thereto. The lower roller 9*b* may be replaced by a flat table having a flat and smooth surface causing little friction.

When producing the surface fastener SF according to the invention by means of the surface fastener manufacturing apparatus having the features as described above, firstly molten resin 4 continuously injected from the injection nozzle 6 under predetermined resin pressure is introduced into the gap between the injection nozzle 6 and the die wheel 5 so that the gap is filled by part of the molten resin 4 to form the substrate 1 while the cavities 51 for forming intermediary engaging elements arranged on the outer peripheral surface of the die wheel 5 are sequentially filled with the remaining molten resin 4 to produce intermediary engaging elements 2' arranged on the surface of the substrate 1 and hence an intermediary surface fastener SF' as the die wheel 5 is rotated.

Then, as the intermediary surface fastener SF' for producing a final surface fastener SF according to the invention is rotated by a half circle around the outer peripheral surface of the die wheel 5 and guided by a guide roller 13, it is positively cooled by the water-cooling jacket 7*a* contained in the die wheel 5 and, at the same time, also rapidly cooled by the circulating cold water (about 15° C.) in the cooling water tank 7*b* so as to promote solidification. Due to the rapid cooling, the intermediary surface fastener SF' is solidified before it is significantly crystallized so that the substrate 1 and the engaging elements 2 become very flexible.

After being set, the substrate 1 is taken up by the take-up rollers 10, 11 and the intermediary engaging elements 2' that have been molded, cooled and solidified in the respective cavities 51 are pulled out smoothly as they are elastically and linearly deformed. Under this condition, the intermediary engaging elements 2' restore their original profile but not completely, and the engaging heads 23' have configuration that the bending angle of the engaging heads 23' with respect to the stem 21' is slightly more upright than the Y-shape of the cavity 51.

The pair of take-up rollers 10, 11 that are synchronously driven to rotate in opposite directions as described above are used to pull out the intermediary surface fastener SF' from the die wheel 5. While the take-up rollers 10, 11 may have smooth peripheral surfaces, they may be covered by a soft and elastic urethane layer to protect the engaging elements 2 from undesired damages.

The produced intermediary surface fastener SF' is then trimmed by removing the lateral selvages by means of the trimming unit (not shown) before it is made to pass between the paired upper and lower rollers 9*a*, 9*b*. As the surface fastener SF' passes between the rollers 9*a*, 9*b*, the tops of the engaging heads 23' of each engaging element 2 is heated and pressed by the upper heating roller 9*a* so that the engaging heads 23' are slightly bent forward from the base toward the front end while the top of each engaging head 23' is softened and deformed to produce the flat plane P on the top and bulged sections 23*a*' extending laterally from the top. Thus, the engaging elements 2 are made to show the final profile. The flat plane P may show a slight central recess in the subsequent cooling steps depending on the molding conditions.

The surface fastener SF produced as the intermediary surface fastener SF' is made to pass between the upper and lower rollers 9*a*, 9*b* does not require to be cooled by specifically arranged cooling means and simply ends the manufacturing process when it is wound up at room temperature. The fact that, after heating and softening the top of each engaging head 23 of the engaging elements 2 and pressing it to produce the flat plane P and lateral bulged sections 23*a*', the engaging elements 2 are gradually cooled without using any specific cooling means is important because the resin materials of the top 23*a* of each engaging head 23 that has been heated, softened and pressed to become deformed is crystallized to a considerable extent and hence the engaging heads 23 become rigid much more than the stems 21 and the substrate 1.

Figure 13:
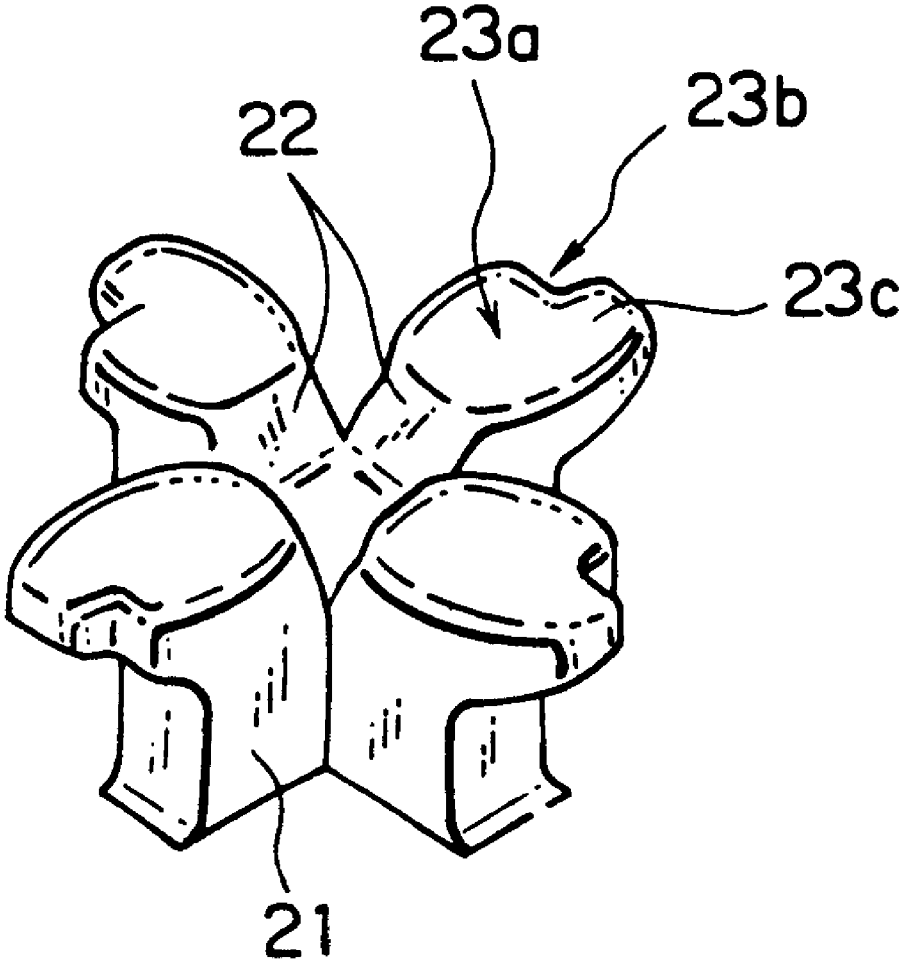
FIG. 13 is a schematic perspective view of another finished engaging element produced from an intermediary engaging element.

As a result of that only the engaging heads 23 of the intermediary surface fastener SF' become rigid much more than the substrate 1 and the remaining components of the engaging elements 2, the engaging heads 23 maintain a satisfactory level of rigidity for holding the mating loops of the matching surface fastener if the engaging elements 2 of the surface fastener SF are dimensionally made very small and the remaining components of the surface fastener SF are made very soft. Thus, while the molded surface fastener SF according to the invention is very flexible and has very small engaging elements to improve its touch, it is a high-quality product that provides a satisfactory engaging strength, has a quite stable configuration, and can withstand a number of repeated use. While two engaging heads 23 extend oppositely from a single stem of each engaging element 2 in the above embodiment, the number of engaging heads 23 extending from a single stem of a single engaging element 2 is not limited to two. Alternatively, it may be so arranged that four engaging heads may extend from a single stem 21 of each engaging element 2 as a cross as shown in FIG. 13.

As described above in detail, with the molded surface fastener having the number of very small engaging elements 2 of the above-described featured, each of the plurality of engaging heads 23 extend from the single stem 21 of each engaging element 2 by way of respective necks 22 has one or more than one cut-out 23*b* at the front end thereof so that the front end of the engaging head 23 is made further smaller than any other components and can easily move into the mating loop even if the mating loop is a very small one which appears on a surface of non-woven fabric. On the other hand, even though the distal ends of the engaging heads 23 are small, other parts still have enough size to maintain necessary strength, so that the engaging elements 2 are had to fall flat.

Additionally, in a molded surface fastener according to the invention, the top of each engaging head 23 is substantially flat and has laterally extending bulged sections 23*a*', while it has such a specific configuration that it is tapered toward the front end, so that the engaging heads 23 as a whole provide an improved touch. Each engaging head 23 may be made to incline and rise upward from the corresponding stem 21 with the inclination angle greater than 90° to make the engaging head 23 move into the mating loop of the matching surface fastener more easily in combination with the feature that the distal end is tapered. Such an engaging head 23 can hardly be released from the mating loop of the matching surface fastener because of the provision of lateral bulged sections (23*a*') so that it operates to prevent the mating loop from moving away if the surface fastener is subjected to the peeling force during engagement with the mating loops. As a result, although the mating loop is small, they engage stably without damaging their shape, and when the force is exerted in peeling direction, the neck 22 is deflected in peeling direction while the engaging head 23 is deformed so that the loop moves smoothly in disengaging direction with a desired friction along edges of the bulged sections 23*a*' thus the loop can disengage from the engaging head 23 smoothly.

Thus, the engaging elements 2 of a surface fastener according to the invention and having a profile as described above provide an excellent touch and can easily and reliably engage with mating loops of the matching surface fastener to secure a desired engaging strength even if the loops are fine and small. Additionally, unlike known mushroom-type engaging elements 2 that can easily be hung by mating loops as the loops get caught around the neck 22 between the stem 21 and the engaging head 23, a surface fastener according to the invention can be peeled off the matching surface fastener without damaging the engaging elements 2 and the mating loops, maintaining a predetermined peeling strength and improving durability.

Particularly, if the engaging heads 23 of an intermediary surface fastener according to the invention that has been cooled and solidified rapidly after the molding process are treated by heating and pressing means and gradually cooled to room temperature to be solidified to form the opposite bulged sections 23*a*', the engaging heads 23 become rigid more than the remaining components of the surface fastener while maintaining the flexibility of the molded surface fastener so that the strength to hold the mating loops is further improved and the stability of the configuration can be secured.

Additionally, the touch of the surface fastener will be improved further if ratio of the total surface area of the flat planes P of the engaging heads 23 relative to the surface area of the flat substrate 1 is larger than the conventional. Such a surface fastener can reliably be transferred onto an object of application such as a paper diaper by appropriate suction means.

Finally, when the surface of the stem 21 of the engaging element 2 on the side of extension of each engaging head 23 is located substantially directly under the center of the flat plane P, the engaging head 23 is securely supported from below, and thus the engaging element 2 is held under pressure to prevent the engaging head 23 from being deformed so that the engaging head 23 would not be deformed under high pressure and the engaging elements 2 would not reduce the engaging ratio relative to a matching surface fastener.

What is claimed is:

1. A surface fastener comprising, as integrally molded members thereof:

(a) a flat substrate; and (b) a large number of engaging elements standing from a surface of said substrate and adapted to releasably engage with mating loops of a matching surface fastener, wherein each of said engaging elements has a stem, at least two necks extending radially in different directions from the stem and engaging heads substantially linearly extending from the stems in said different directions by way of the respective necks and each of said engaging heads has at least a cut-out formed at the remote end thereof transversally relative to the extending direction of the engaging head.

2. A surface fastener according to claim 1, wherein said cut-out is formed at a lateral edge of the corresponding engaging head along a line normal to the extending direction of the engaging head.

3. A surface fastener according to claim 2, wherein said cut-outs of the engaging heads are arranged in mirror symmetry relative to the boundary line of the necks extending oppositely relative to the axial line of the stem.

4. A surface fastener according to claim 2, wherein said cut-outs of the engaging heads are arranged in point symmetry relative to the axial line of the stem form which the engaging heads are extending oppositely.

5. A surface fastener according to claim 1, wherein said cut-outs are arranged respectively at the opposite lateral edges of the engaging head along a line normal to the extending direction of the engaging head.

6. A surface fastener according to claim 1, wherein said cut-out is arranged at the center of the distal end along a line normal to the extending direction of the engaging head.

7. A surface fastener according to claim 1, wherein each engaging head has at a top thereof a bulged section protruding substantially horizontally at least in a direction normal to the extending direction of the engaging head and the top of the engaging head is substantially flat.

8. A surface fastener according to claim 7, wherein said engaging head is made more rigid than said stem.

9. A surface fastener according to claim 7, wherein at least the top including the bulged sections of the engaging head is made more rigid than the remaining parts of the engaging element.

10. A surface fastener according to claim 7, wherein the stem of each engaging element rises vertically from the. surface of the substrate and a surface of the stem on the side of extension of the engaging head is located substantially directly under the center of the to p of the engaging head.

11. A surface fastener according to claim 7, wherein the oppositely disposed rear sides of the necks of each engaging element rise aslant from the center of the top of the stem in diverging directions.

12. A surface fastener according to claim 7, wherein the bottom of a gap between the rear sides of the necks of each engaging element is located on a line connecting lower ends of bottom surfaces of the engaging heads.

13. A surface fastener according to claim 7, wherein the height of the top of the front end of the engaging head of each engaging element from the surface of the substrate is between 0.2 and 1.2 mm and the front end of the engaging head extends from the stem by a distance between 0.05 and 0.7 mm, the stem having a height between 0 and 1.0 mm.

14. A surface fastener according to claim 7, wherein the total area of the surfaces of the flat tops of the engaging heads of the engaging elements is between 20 and 50% of the surface area of the substrate.

15. A surface fastener according to claim 7, wherein the engaging head has at the top a width that is between 50 and 70% of the total width including said bulged section as viewed in the extending direction of the engaging head.

16. A surface fastener according to claim 7, wherein the engaging head of each engaging element is made to bend and extend linearly from the supporting neck with an angle of $O<\theta\leqq 35°$ between the top surface of the engaging head and the horizontal plane and an angle of $5\leqq\theta'\leqq 45°$ between the bottom surface of the engaging head and the horizontal plane.

17. A surface fastener according to claim 7, wherein the engaging head is tapered toward the front end such that the thickness of the front end of the engaging head is between 50 and 90% of the thickness of the base section of the engaging head.

18. A surface fastener according to claim 7, wherein the each of said cut-outs has a length of about ½ of a length of the engaging head from the stem.

19. A surface fastener according to claim 1, wherein a number of recesses are provided on the surface of the flat substrate at desired locations thereof and each engaging element rises from the bottom of corresponding one of said recesses.

20. A surface fastener according to claim 19, wherein each said recess has a width large enough to allow a mating loop to be introduced therein.

21. A surface fastener according to claim 19, wherein the height of the stem from the bottom of the corresponding recess is between ⅕ and 9/10 of the height of the front end of the top of the engaging head from the bottom of the recess.

* * * * *